United States Patent [19]

Niven, Jr. et al.

[11] Patent Number: 4,727,889

[45] Date of Patent: Mar. 1, 1988

[54] TOBACCO PROCESSING

[75] Inventors: Benjamin F. Niven, Jr., Winston-Salem; Charles D. Mays, Lewisville, both of N.C.

[73] Assignee: R. J. Reynolds Tobacco Company, Winston-Salem, N.C.

[21] Appl. No.: 944,076

[22] Filed: Dec. 22, 1986

[51] Int. Cl.[4] ..... A24B 15/24; A24B 15/26

[52] U.S. Cl. ..... 131/297; 131/298

[58] Field of Search ..... 131/297, 298, 296

[56] References Cited

U.S. PATENT DOCUMENTS 3,424,171 1/1969 Rooker .
4,150,677 4/1979 Osborne, Jr. et al. .
4,153,063 5/1979 Roselius et al. .
4,215,706 8/1980 Larson et al. .
4,243,056 1/1981 de la Burde et al. .
4,289,148 9/1981 Ziehn .
4,461,310 7/1984 Ziehn .
4,506,682 3/1985 Muller .
4,531,529 7/1985 White et al. .
4,561,452 12/1985 Gahrs .
4,577,646 3/1986 Ziehn .

*Primary Examiner*—V. Millin
*Attorney, Agent, or Firm*—Grover M. Myers

[57] ABSTRACT

Flue-cured tobacco can be treated with burley tobacco flavor components and subjected to volume expansion conditions. Flavor components are supercritically extracted from burley tobacco and directly applied to the flue-cured tobacco while the extraction fluid is in a supercritical or subcritical state.

9 Claims, 1 Drawing Figure

TOBACCO PROCESSING

BACKGROUND OF THE INVENTION

This invention relates to the processing of smokable material, and in particular to such processing involving the extraction of tobacco materials.

The extraction of tobacco components such as flavors has become a subject of interest in recent years. For example, U.S. Pat. No. 4,506,682 to Adam Muller discloses a process for obtaining aromatic materials from a tobacco extract. Typical tobacco extraction processes involve isolating extracted tobacco materials, and then employing the extracts as additives (often in diluted form) to smokable materials useful in the manufacture of smoking articles.

It would be highly desirable to provide an efficient and effective process for extracting tobacco components such as flavors from a tobacco material and directly applying the extracted components to smokable materials.

SUMMARY OF THE INVENTION

This invention relates to a process whereby flavors from a sample of tobacco material are applied to a sample of smokable material in order to improve or enhance the taste characteristics of the smokable material. In a preferred aspect, this invention relates to a process for expanding the smokable material as well as applying flavors from tobacco material thereto.

More particularly, the present invention relates to a process for providing a flavored smoking material, whereby tobacco components from tobacco material are extracted with a fluid under supercritical conditions thereby providing extracted tobacco components within the fluid. The extracted tobacco components within the fluid, while the fluid is in a supercritical or subcritical state, are then contacted with a smokable material under conditions sufficient to provide smokable material in intimate contact with the extracted tobacco components.

In addition, the present invention relates to a process for providing a flavored smoking material of increased filling capacity wherein the smokable material is subjected to a supercritical or subcritical expansion process either prior to or after the time that the smokable material is contacted with supercritically extracted tobacco components as described hereinbefore.

As used herein, the term "supercritical" means at or above the critical point of the solvent (eg., fluid) with respect to temperature and pressure.

As used herein, the term "subcritical" means below the critical point of the solvent (eg., fluid) with respect to temperature and pressure.

The process of this invention allows the skilled artisan to efficiently and effectively extract selected desirable components from a sample of a particular tobacco or blend of tobaccos, and provide a sample of smokable material treated with the extracted tobacco components. Thus, the treated smokable material can have an enhanced flavor. The extracted components can be transferred directly to the filler material as opposed to isolating the extracted components for later contact with the filler material. In particular, a fluid in a supercritical state and containing supercritically extracted tobacco components is passed from the extraction container to the container containing the smokable material. Then, the solubility of the extracted components in the fluid is reduced, and the extracted tobacco components are left to reside in intimate contact with the smokable material.

Also of particular interest is the fact that smokable material can be expanded to ultimately yield a product having increasing filling capacity. The expansion process can be performed either before or after the processing steps involved in contacting the extracted tobacco components with the smokable material.

DETAILED DESCRIPTION OF THE EMBODIMENTS

Figure 1:
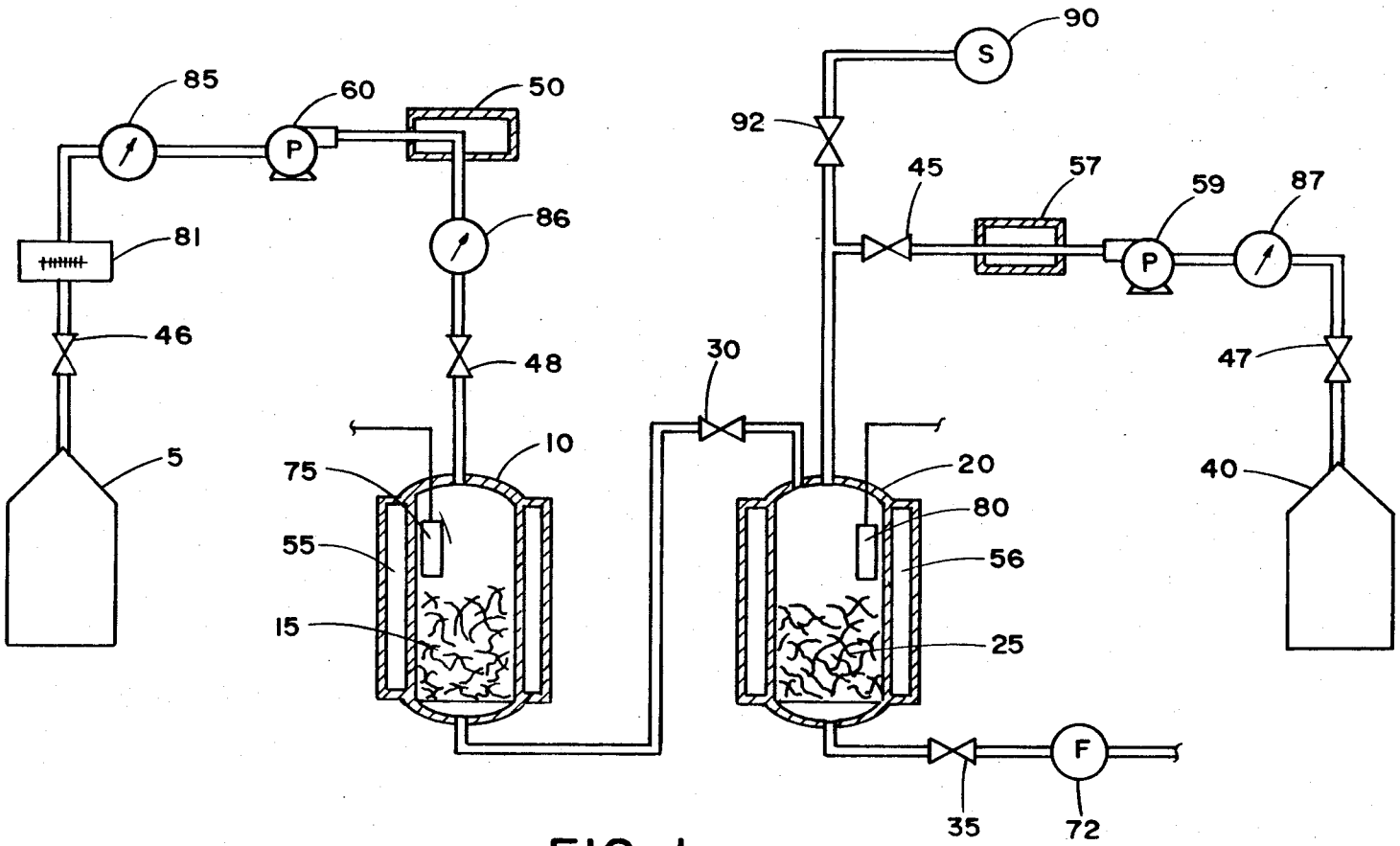
FIG. 1 is a schematic illustration of an apparatus useful in the process of this invention.

Referring to FIG. 1, an extraction solvent is contained in vessel 5 and can be passed to high pressure extraction cylinder 10 which contains tobacco material 15. The high pressure extraction container or cylinder 10 is connected to a high pressure receiver container 20 which contains smokable material 25. Valve 30 positioned between the extraction cylinder 10 and receiver container 20 is opened in order to allow the solvent in a supercritical state and supercritically extracted components to be transferred from extraction cylinder 10 to receiver container 20. An outlet valve 35 positioned at the outlet region of receiver container 20 provides for venting of solvent after the smoking material in the receiver container has been subjected to contact with the solvent containing the extracted tobacco materials.

The apparatus also includes a second vessel 40 for expansion solvent. The second vessel is connected to high pressure receiver container 20. Shut off valve 45 between the second vessel 40 and the receiver container 20 is opened in order to allow the expansion solvent to be transferred from the second vessel to the receiver container. Outlet valve 35 provides for venting of the expansion solvent from the receiver container 20. Shut off valves 46 and 47 are positioned near the outlet regions of extraction solvent vessel 5 and expansion solvent vessel 40, respectively. Shut off valve 30 is positioned near the point at which the extraction solvent can enter the receiver container. The various connecting means which connect the various components referred to herein and which are shown in FIG. 1 are tubular members such as metal pipe or hose and are manufactured from pressure resistant materials.

The apparatus also includes a heat exchange unit 50 which provides for heating of extraction solvent to the desired temperature. A second heat exchange unit 55 provides for controlled heating of the high pressure extraction cylinder 10. A third heat exchange unit 56 provides for controlled heating of the high pressure receiver container 20. Other heating units can be positioned at certain points in the apparatus in order to maintain the desired temperature of solvent at particular regions therein. In particular, certain heating units can be positioned near valves or other expansion areas. It is particularly desirable to position heat exchange unit 57 between high pressure pump 59 and receiver container 20 in order to ensure that expansion solvent enters the receiver container at the desired temperature. In addition, a second high pressure pump 60 provides for the transfer of extraction solvent from vessel 5 into the extraction cylinder 10, pressurize the extraction cylinder and maintain the desired pressure within the extraction cylinder. Second pump 60 has the capacity to maintain a constant pressure within the vessel 10, and to maintain a constant pressure flow of solvent, as for example an intermediate or continuous flow, using a pressure control valve. Such capacity can be provided by a recycle means, or the like. Similarly a first high pressure pump 59 provides for (i) the transfer of expansion solvent from second vessel 40 into the high pressure receiver container 20, and (ii) the pressurization of the receiver container to the desired pressure. If desired, either of the pumps 59 and 60 can be replaced by compressors, or other pressure generating means. Pumps 59 and 60 can be a common pump with appropriately manipulated valves and piping.

Flow control meter 72 is positioned downstream from outlet valve 35 of receiver container 20. The flow control meter 72 provides a means for measuring the amount of process fluid exiting the receiver container, thereby allowing for the determination of the amount of process fluid employed in a particular process step.

Temperature sensing means such as thermocouples 75 and 80 are positioned within the extraction cylinder and receiver container, respectively. Other temperature sensing means can be positioned throughout the apparatus. For example, temperature sensing means 81 can be positioned between vessel 5 and pump 60 in order to monitor the extraction solvent. Thus, appropriate steps can be taken to ensure that the solvent is in the desired form during pumping operations.

Pressure gauges 85, 86 and 87 are positioned throughout the apparatus. For example, pressure gauge 85 is positioned between vessel 5 and pump 60 in order to monitor the extraction solvent entering the extraction cylinder 10. Thus, appropriate steps can be taken to ensure that adequate extraction solvent enters the extraction cylinder. Pressure gauge 86 is positioned very near extraction cylinder 10 in order to monitor the pressure within the cylinder for the determination of supercritical or subcritical extraction conditions. Pressure gauge 87 is positioned between second vessel 40 and pump 59 in order to monitor the pressure of the expansion solvent contained in the second vessel.

The moisture content of smokable material can be adjusted by a moisture source 90 such as a steam line, or the like. The amount of moisture employed for contact with the smokable material 25 can be controlled using control valve 92 which is positioned between the moisture source and the receiver container 20.

In operation, the extraction cylinder 10 is heated to the desired temperature and pressurized using extraction solvent from vessel 5. The extraction solvent is maintained in the extraction cylinder for a period of time sufficient to establish supercritical conditions and maintain such conditions for the desired time period such that the solvent (i.e., fluid) containing supercritically extracted tobacco components can be passed directly at a controlled flow rate to the receiver container 20. Thus, the solvent is in a supercritical state at least at that point at which it exits the extraction cylinder 10 for transfer to the receiver container 20.

Preferably, the receiver container is maintained under conditions of lower pressure than that pressure experienced in the extraction cylinder in order to provide for adequate deposition of extracted tobacco components onto the smokable material (i.e., in order to provide the smokable material in intimate contact with the extracted tobacco components). In such a manner, the fluid may be in a supercritical state or subcritical state when contact with the smokable material is accomplished. Outlet valve 35 is adjusted in order to regulate the solvent flow. The flow rate of the solvent throughout the apparatus is dependent upon a variety of factors. For example, an essentially steady state, continuous process can have a fluid flow rate which is dependent upon factors such as the extraction solvent, the solubility characteristics of the solvent, the capacity of the pump, the desired efficiency of the process, and other such factors.

If desired, the receiver container 20 can be equipped with a device such as a movable piston in order to increase or decrease the volume of the receiver container in a controlled manner. For example, each of the extraction cylinder 10 and receiver container 20 can be pressurized with fluid until the fluid therein reaches the desired supercritical state. The valve 30 is adjusted in order to effect a fluid flow from the extraction cylinder to the receiver container. Pressure is maintained within system by pump 60, and the volume of receiver container 20 is increased thereby effecting a transfer of extracted tobacco components to the receiver container. At a desired point in time, valve 30 is closed, and the receiver container is further increased in volume in order to deposit the extracted tobacco components onto the smokable material. Valve 35 is then opened, and the solvent is vented. Such a process can be performed several times in order to provide a desirably high level of transferred extracted components.

The smokable material 25 which is in intimate contact with the extracted tobacco components is removed from the receiver container 20 and employed in the manufacture of smoking articles such as cigarettes. Alternatively, the smokable material is left in the receiver container for subsequent expansion processing.

The expansion process steps are performed by heating the receiver cylinder 20 to the desired temperature and pressurizing the cylinder using the expansion solvent by means of valve 45. The expansion solvent is maintained in the receiver container for a period of time sufficient to impregnate the smokable material. The receiver container is then vented quickly or rapidly by closing valve 45 and opening the outlet valve 35.

The smokable material is subjected to volume expansion conditions in order to increase the filling capacity thereof. An exemplary process setting forth suitable expansion conditions and agents is disclosed in U.S. Pat. No. 4,531,529 to White et al, which is incorporated herein by reference. The smokable material can be subjected to volume expansion under supercritical or subcritical conditions followed by the contacting thereof with extracted tobacco material within a fluid while the fluid is in supercritical or subcritical form. Alternatively, as previously discussed, the smokable material can be contacted with the tobacco material within a fluid while the fluid is in supercritical or subcritical form, followed by the subjection thereof to volume expansion under supercritical or subcritical conditions. Furthermore, a certain amount of volume expansion of the smokable material can be effected by rapidly venting the receiver container of extraction solvent.

The tobacco material which is extracted or processed according to this invention can vary. Examples of tobaccos include burley, oriental, Maryland or flue-cured tobaccos, or blends thereof. Preferably, the extracted tobacco is burley tobacco. The tobacco material can have a variety of forms such as scrap (eg., fines, dust, stems, etc.), cut filler, pieces of laminae, whole leaf, or the like.

The smokable material can vary. Examples of smokable materials most preferably include tobaccos such as flue-cured, oriental, tobaccos of various grades, tobacco substrates, reprocessed tobaccos, or blends thereof. Flue-cured tobacco is particularly preferred. The form of the smokable material preferably is in a form suitable for use and/or processing for the manufacture of smoking articles such as cigarettes. For example, tobacco laminae, whole leaf or cut filler can be employed. Most preferably, the smokable material is employed in the form of cut filler which can be subjected to volume expansion conditions. Such cut filler is most advantageously useful in the manufacture of cigarettes.

The flavored smoking materials which are obtained according to this invention are those smoking materials described hereinbefore which have in intimate contact therewith the extracted components from the previously described tobacco materials. By the term "intimate contact" is meant that the extracted components are deposited on, impregnated within, adsorbed on, absorbed within (in either a chemical or physical manner) the smokable material such that the extracted components do not readily separate from the smokable material under normal handling conditions.

The solvent used for extraction can vary and is any solvent or fluid suitable for supercritically extracting components from the tobacco material. Examples of solvents include carbon dioxide, dichloromethane, difluoroethane, the commercially available Freons, n-propane, n-pentane, n-heptane, n-hexane, cyclohexane, ethanol, n-pentanol, toluene, acetone, methyl acetate, diethylether, petroleum ethers, as well as mixtures thereof. Expansion solvents can vary and are any fluids which can impregnate and thus provide volume expansion of the smokable material. Although the expansion solvent can be the same solvent as the extraction solvent, it is most desirable that the expansion solvent be a poorer solvent (or be employed under conditions such that it behaves as a poorer solvent) than the extraction solvent in order that the previously extracted components not be removed to an appreciable degree upon venting of the expansion solvent.

Extraction temperatures depend upon factors such as the pressure within the extraction cylinder, the solvent system, the components to be extracted, and other such factors. Typically, extraction temperatures are determined experimentally. Generally, the desired supercritical conditions are achieved by maintaining a desired pressure substantially constant while varying the temperature within the cylinder, or vice versa.

The moisture content of each of the tobacco material and smokable material can be adjusted. For example, the moisture content of the tobacco material can be adjusted to a desired level in order to promote the extraction of a particular component. In particular, it may be desirable to adjust the moisture level of the tobacco material to about 20 weight percent in order to optimize the extraction efficiency of a nicotine component. In addition, the moisture content of the smokable material can be adjusted in order to optimize expansion thereof and provide a resulting product which is not overly brittle. In particular, optimum expansion conditions may occur for a smokable material having a moisture content of about 14 to about 16 weight percent, while it may be desirable to provide a final product having a moisture content of about 12 to about 13 weight percent.

The following examples are provided in order to further illustrate the invention but should not be construed as limiting the scope thereof. Unless otherwise noted, all parts and percentages are by weight.

EXAMPLE 1

Flue-cured tobacco is treated with a burley tobacco extract and then expanded using an apparatus substantially as shown in FIG. 1.

A 15 g sample of burley tobacco cut filler (average width of strips is about 1/32 inch and average length of strips is from about 0.5 inch to about 2 inches) is charged into a 75 cc extraction cylinder. The tobacco has a nicotine content of 3.56 percent, and enough moisture in the form of water is added to the tobacco to provide tobacco having a moisture content of 20 percent. The extraction cylinder is manufactured from alloy steel and is commercially available as Autoclave Part No. CNLX 16012 from Autoclave Engineering, Inc., Erie, Pa.

An 8 g sample of flue-cured tobacco cut filler (average width of strips is about 1/32 inch and average length of strips is about 0.5 inch to about 2 inches) is charged into a receiver container. The tobacco has a nicotine content of 2.59 percent, and enough moisture in the form of water is added to the tobacco to provide tobacco material having a moisture content of 30 percent. The receiver container is similar in construction to the previously described extraction cylinder.

Carbon dioxide is pumped from a storage tank using a Milton Roy Duplex Pump, Model No. 2396-89 into the extraction cylinder. The extraction cylinder is heated to an internal temperature of 90° C. and the pressure within the extraction cylinder is increased to 5800 pounds/square inch gauge (psig). At this time, effluent in the form of supercritical carbon dioxide and extracted components from the burley tobacco are passed through a needle valve to the receiver container at the rate of 0.2 standard cubic feet/minute (SCFM) with fresh carbon dioxide being introduced to maintain the extraction cylinder pressure at 5800 psig. The carbon dioxide and extracted tobacco components are directly contacted with the flue-cured tobacco cut filler, and the carbon dioxide is vented from the receiver container using the outlet valve. The flue-cured cut filler is treated in such a way for a total of 86 minutes. A total flow of 16.4 cubic feet of carbon dioxide is passed through the receiver container.

The receiver container is opened and a mass of yellow colored gummy substance is found on the cut filler nearest the inlet of the container. The gummy substance and 1.5 ml of water is blended with the smokable material cut filler. The material is returned to the receiver container and each of the inlet and outlet ends thereof are plugged with gas permeable glass wool.

The receiver container is closed and heated to an internal temperature of 105° C. using an external electric heating element. Propane expansion gas from a storage tank is pumped using a Milton Roy Model 396-89 stainless steel pump having a saphire plunger into the receiver container. When the pressure within the receiver container reaches 2000 psig, the receiver container is vented to the atmosphere rapidly (eg., uninhibited venting over about a 2 second period) by opening the outlet valve.

The flue-cured cut filler which is recovered is very slightly lighter in color than the starting material, exhibits a 58 percent filling capacity increase over the starting material, and resembles conventionally volume expanded tobacco material. The nicotine content of the treated flue-cured filler is 4.17 percent. The nicotine content of the extracted burley tobacco material is 0.63 percent. The moisture content of the recovered smokable material is about 10 to about 13 percent.

EXAMPLE 2

Flue-cured tobacco is treated with a burley tobacco extract and then expanded using an apparatus substantially as shown in FIG. 1 and described in Example 1.

A 15 g sample of burley tobacco cut filler is charged into the extraction cylinder. An 8 g sample of flue-cured tobacco cut filler is charged into the receiver container. Each of the tobaccos are described in Example 1.

Carbon dioxide is pumped into the extraction cylinder (which is heated to an internal temperature of 89° C.) and extraction is carried out in the manner described in Example 1. However, the flue-cured cut filler is directly contacted with extraction fluid and extracted tobacco components for a total of 60 minutes such that a total flow of 13.1 cubic feet of carbon dioxide is passed through the receiver container.

The receiver container is not opened after transfer of the fluid and extracted components thereto. About 0.5 ml of water is added to the receiver container. The receiver container is heated to an internal temperature of 224° F. Propane is introduced into the receiver container, and the container is rapidly vented under conditions and in the manner described in Example 1.

The flue-cured cut filler which is recovered is very slightly lighter in color than the starting material, exhibits a 60 percent filling capacity increase over the starting material, and resembles conventionally volume expanded tobacco material. The nicotine content of the treated flue-cured filler is 4.83 percent. The nicotine content of the extracted burley tobacco material is 0.88 percent. The moisture content of the recovered smokable material is about 10 to about 13 percent.

What is claimed is:

1. A process for providing a flavored smoking material, the process comprising:
   (a) extracting tobacco components from tobacco material with a fluid under supercritical conditions thereby providing extracted tobacco components within the fluid; and then directly
   (b) contacting the extracted tobacco components within the fluid, while the fluid is in a supercritical or subcritical state, with a smokable material under conditions sufficient to provide smokable material in intimate contact with the extracted tobacco components.

2. A process for providing a flavored smoking material of increased filling capacity, the process comprising:
   (a) extracting tobacco components from tobacco material with a fluid under supercritical conditions thereby providing extracted tobacco components within the fluid; and then directly
   (b) contacting the extracted tobacco components, while the fluid is in a supercritical or subcritical state, with a smokable material under conditions sufficient to provide smokable material in intimate contact with the extracted tobacco components; and then
   (c) subjecting the smokable material to a supercritical or subcritical expansion process.

3. A process for providing a flavored smoking material of increased filling capacity, the process comprising:
   (a) subjecting smokable material to a supercritical or subcritical expansion process thereby providing an expanded smokable material; and then
   (b) extracting tobacco components from tobacco material with a fluid under supercritical conditions thereby providing extracted tobacco components within the fluid; and then directly
   (c) contacting the extracted tobacco components, while the fluid is in a supercritical or subcritical state, with the expanded smokable material under conditions sufficient to provide smokable material in intimate contact with the extracted tobacco components.

4. The process of claim 1, 2 or 3 wherein the tobacco material is burley tobacco.

5. The process of claim 1, 2 or 3 wherein the smokable material is flue-cured tobacco.

6. The process of claim 1, 2 or 3 wherein the fluid for supercritically extracting tobacco components from the tobacco material is carbon dioxide.

7. The process of claim 2 or 3 wherein the supercritical or subcritical expansion process is performed using propane as an expansion gas.

8. The process of claim 1, 2 or 3 wherein the smokable material is contacted with the fluid while the fluid is in a supercritical state.

9. The process of claim 1, 2 or 3 wherein the smokable material is contacted with the fluid while the fluid is in a subcritical state.

* * * * *